United States Patent [19]

Boada Sucarrats

[11] Patent Number: 4,770,156

[45] Date of Patent: Sep. 13, 1988

[54] APPARATUS FOR CUTTING SUBSTANTIALLY FLAT CERAMIC PIECES

[75] Inventor: Antonio Boada Sucarrats, Barcelona, Spain

[73] Assignee: Hermanos Boada, S.A., Barcelona, Spain

[21] Appl. No.: 66,836

[22] Filed: Jun. 25, 1987

[30] Foreign Application Priority Data

Jun. 25, 1986 [ES] Spain ..... 295592

[51] Int. Cl.[4] ..... B28D 1/32

[52] U.S. Cl. ..... 125/23 R; 225/96.5; 225/103

[58] Field of Search ..... 125/23 R, 23 C, 23 T; 225/96.5, 103

[56] References Cited

U.S. PATENT DOCUMENTS

| | | | |
|---|---|---|---|
| 4,026,262 | 5/1977 | Yasuga | 125/23 T |
| 4,046,299 | 9/1977 | Swartzfager | 30/164.95 X |
| 4,693,232 | 9/1987 | Yasuga | 125/23 T |

FOREIGN PATENT DOCUMENTS

| | | | |
|---|---|---|---|
| 212244 | 1/1958 | Australia | 125/23 R |
| 2556094 | 10/1976 | Fed. Rep. of Germany | 125/23 R |
| 2647331 | 4/1977 | Fed. Rep. of Germany | 125/23 R |
| 2716085 | 10/1978 | Fed. Rep. of Germany | 125/23 T |
| 3015385 | 10/1981 | Fed. Rep. of Germany | 225/96.5 |
| 932640 | 6/1963 | United Kingdom | 125/23 R |

*Primary Examiner*—Frederick R. Schmidt
*Assistant Examiner*—Shirish Desai
*Attorney, Agent, or Firm*—Steinberg & Raskin

[57] ABSTRACT

Apparatus for cutting substantially flat ceramics pieces, having a frame for supporting the piece to be cut, over which a head carrying a cutting line-scoring tool slides. A freely-oscillating fork is arranged rearward of the position of engagement of the scoring tool, with legs on the fork resting on the piece to be cut on both sides of the scoring or marking line. A cranked lever is articulated on the frame and has a forward end projecting through an opening in the frame and a forward arm actuated by the tool carrier head at the instant the piece is broken or severed, to cause the rearward end to protrude and support the piece for breaking or severing.

16 Claims, 2 Drawing Sheets

APPARATUS FOR CUTTING SUBSTANTIALLY FLAT CERAMIC PIECES

BACKGROUND OF THE INVENTION

The present invention relates to apparatus intended for cutting substantially flat ceramic pieces such as plates, tiles and the like.

Apparatus directed to cutting flat ceramic pieces, which are well known, have been constituted by a substantially flat frame for supporting the piece to be cut, with rising supports located at the ends thereof and carrying two fixed parallel bars which serve as a rail and a sliding guide for a hand lever-operated head carrying a tool for scoring the line where the cut is to be made. In some instances, the apparatus is provided with a device intended for performing the breaking of the scored or marked pieces.

In general, complication of the apparatus structure, in addition to tremendous increase in the cost of the apparatus itself, result from the arrangement of these additional devices for breaking or severing the pieces which have been marked with the score lines for cutting, especially when such cutting devices are to be operated by levers and annexed devices in addition to those members of which the apparatus is provided for cutting and scoring the ceramic pieces themselves.

However, if operation of the breaking or severing devices is attained by the same operating lever of the scoring tool carrier head, then the device intended for effecting the breaking or severing pressure must be situated forwardly of that scoring tool, thus making visual control of the scoring operation difficult. This constitutes a small but nevertheless significant nuisance in the use of such an apparatus, which, on the whole, has proven to be simple and efficient in all cases.

SUMMARY OF THE INVENTION

Accordingly, it is an object of the present invention to simplify the scoring and cutting of ceramic pieces.

It is also an object of the present invention to accomplish the scoring and cutting of ceramic pieces by a single operation.

It is another object of the present invention to accomplish the scoring and cutting of ceramic pieces without hindering the view of the scoring thereof.

It is a further object of the present invention to accomplish the scoring and cutting of ceramic pieces by operation of a single lever.

These and other objects are attained by the present invention which is directed to apparatus for cutting substantially flat ceramic pieces comprising a substantially flat frame for supporting a piece to be cut, at least one terminal support, and at least one bar supported on said at least one terminal support, with a head slidaby mounted upon the bar. A cutting line-scoring or marking tool is supported upon the head. Breaking means for severing the scored or marked piece are provided, with the breaking means comprising a freely-oscillating fork, having a pair of legs and positioned to rest upon the piece on both sides of a breaking line scored or marked on a surface of the piece by the tool, either during movement of the tool along the piece or at an instant when the piece is severed by said breaking means.

The apparatus of the present invention of the type referred to above and provided with means for performing the breaking or severing of a piece along a cutting scored line, is provided with the elements which are necessary for attaining the required effect without hindering viewing of the scoring which constitutes a basic operation to be performed by the invention apparatus herein. Viewing remains unobstructed, even when the pressing means constituting the breaking means are operated, i.e. the breaking or severing pressure is effected through an operating lever of the tool carrier head itself. Furthermore, other additional operational elements are dispensed with, thus generally resulting in a simplified safe and effective apparatus, with far superior performance as compared to those previous devices and apparatuses which were used as described above.

More particularly, the apparatus of the present invention supports a freely oscillating fork arranged forwardly of the scoring tool engagement zone with the piece (i.e. rearwardly of the cutting tool in the direction of scoring), and advantageously mounted on the head itself which supports the scoring tool at a position which is substantially coplanar with the cutting head, such that the legs of the fork will rest on the piece at both sides of the breaking or scoring line scored or marked by the scoring tool, either during the displacement of the tool, or at the instant when the two parts of the piece are broken or severed.

As a complement to the above oscillating fork, provision is made for an anvil arranged under a plane on which the piece to be cut rests and pivoted or articulated onto the apparatus frame. This anvil is constituted by a cranked lever, the free end of which has a terminal edge or point formed as a small protruding head, the head projecting through an opening in the frame which is substantially centered with the scoring axis or line of the piece to be cut. The opposite end of the lever is formed as an elbowed arm, adapted to rest against the tool carrier head at the instant in which the two scored or marked portions of the piece become severed or separated. Thus, the two carrier head acts to hold the small anvil head in protruding condition through the opening in the frame, with the piece resting thereon for severing or separation of the parts thereof. A spring tending to retain the anvil in constant withdrawn position when the anvil does not receive the action of the above tool carrier head, is arranged rearwardly of the cranked arm of the lever, upon which the tool carrier head rests when the cutting operation is carried out.

The anvil-forming cranked arm, in turn, has the opposite end thereof to the anvil end itself, situated at a slightly higher level then the tool carrier head. This opposite end of the cranked arm is driven forwardly by the tool carrier head at the end of the scoring or marking stroke of the head, so that the opposite end of the cranked lever becomes situated underneath the tool scoring head. In order to attain this effect in a smooth fashion, this opposite end of the cranked lever arm advantageously has a rounded profile at the head engagement zone thereof.

A further feature of the present invention which contributes to the economic advantages provided in construction of the same, is that the supports of the bars for sliding of the scoring or marking tool carrier head are formed of angle irons in turn made of respective metal plates of suitable thickness, and secured to the frame plate and pierced clear through the upper ends thereof by the head guiding bars. The head guiding bars are secured to the angle irons by means of elastic washers, nuts, or any conventional securing element. In particular, the respective bars are secured, at one end thereof, to an outer side, and at the opposite end thereof, on both the inner and outer sides of the opposite angle iron. This construction affords the advantage that, in view of the above fastening, both terminal or end angle irons of each bar mechanically function or do work mechanically. Thus, the metal plate from which these angle irons are made, can be formed much thinner than would be required if only one of the angle irons was active, as was the case when both angle irons were fastened only on a single face or side thereof.

BRIEF DESCRIPTION OF THE DRAWINGS

The present invention will be described in greater detail below, with reference to the accompanying drawings which are included only for purposes. In the drawings.

DESCRIPTION OF THE PREFERRED EMBODIMENTS

Figure 1:
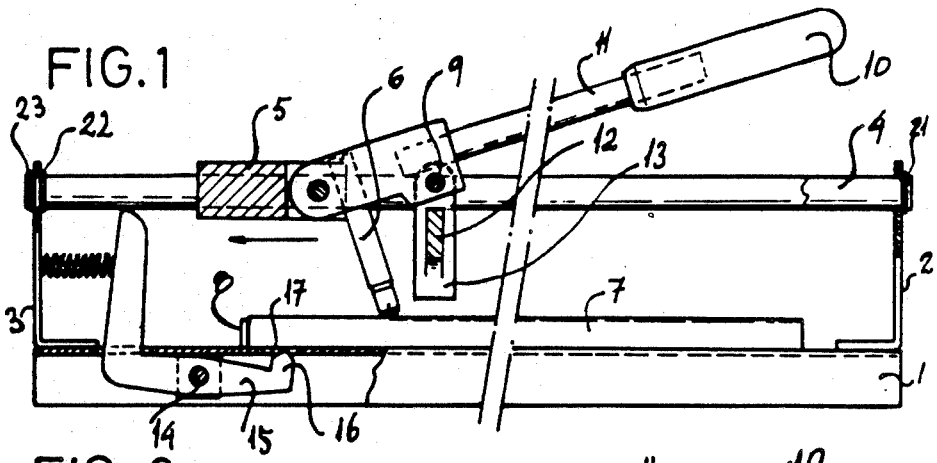
FIG. 1 is a side elevational view of the apparatus of the present invention.

According to the present invention the apparatus is constituted by a plate or frame 1 (in this case, bent metal plate), with terminal supports 2 and 3 to which guide and sliding bars 4 are secured, for a head 5 carrying a tool 6 for scoring or marking of the plate, tile or the like 7. The plate or tile 7 rests upon the frame 1 against a fixed stop protruding from the frame 1 and marked in millimeters or inches.

Figure 5:
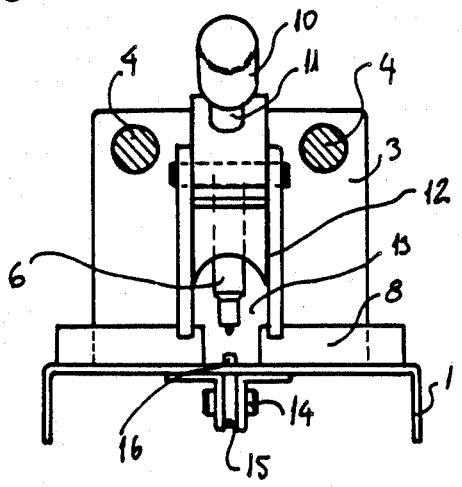
FIG. 5 is a right-side view partially in section, illustrating the guide bars of the invention apparatus in section, and the two carrier head thereof withdrawn.

One feature of the present invention is provision of an articulated and oscillating fork-shaped part 12 having an ample open lower zone 13 through which an operator can view, at any time, the operation of the scoring tool 6 as clearly seen in FIG. 5. The fork-shaped part 12 is arranged at a leading point 9 of the cutting tool head 5, and is arranged forwardly of this tool 6 (with reference to the position of an operator acting upon the handle 10 of the lever of the cutting tool head 5). More particularly, the fork 12 is arranged rearwardly of the scoring or marking tool 6 in the direction of scoring or marking of the piece 7, as best seen by the arrow in FIG. 1.

The fork-shaped piece 12 is substantially centered and located at substantially the same plane as the cutting tool 6, so that both the terminal legs of the fork shaped piece 12 rest on a respective side of the cutting line or axis of the tool 6.

A cranked lever is pivoted or articulated at a point 14 under the frame 1, and has a forward arm 15 forming an upper protrusion 16 in the shape of a point or edge, which is adapted to project through an opening 17 which is formed in the body of the frame, substantially coincident with the breaking line or scoring axis of the tool 6. The cranked lever is formed at its opposite end, with a virtually vertical arm 18 having a rounded end 19, and subjected to the action of a spring 20 which is a compression spring situated between the outer support 3 and the arm 18 itself of the cranked lever. The spring 20 thus tends to oscillate the cranked lever such that the point 16, which constitutes a breaking anvil, always has a tendency to remain hidden underneath the frame 1 in a resting position, as best seen in FIG. 1.

The rounded end 19 of the cranked lever arm 18 is advantageously located at a level which is slightly higher than a sliding plane of the head 5, so that when the head 5 reaches the end position of its stroke after scoring of the piece 7, the head 5 oscillates the cranked lever by impinging onto the rounded surface 19 thereof, until the head 5 becomes superimposed over the rounded surface 19 and pivots the anvil 16 to protrude above the plane of the frame 1. Thus, the piece 7 will be slightly raised (FIG. 2) until the piece 7 reaches the breaking or severing position thereof.

Another feature of the present invention is the manner in which the bars 4 are mounted upon the terminal supports 2 and 3. As may be seen, these bars 4 pierce right through the supports 2 and 3 and, in the case of support 2, are secured by means of an elastic washer or the like 21 at the outer side of the support 2. However, at the opposite support 3, two elastic washers or the like 22, 23 are each placed against a respective face of the support 3. This assembly assures that any flexion stress originating upon the supports when the head 5 moves along the bars 4, is absorbed by both supports 2 and 3 at one time, so that the stress is divided and the supports can thus be formed of a much thinner metal plate.

The operation of the cutter-separator according to the present invention is as follows. In the position illustrated in FIG. 1, scoring or marking of the piece 7 is performed by the tool 6 in a conventional manner, but with the additional advantage that the operator is always able to view the tool 6 through the lower open space 13 of the fork-shaped piece 12.

Figure 2:
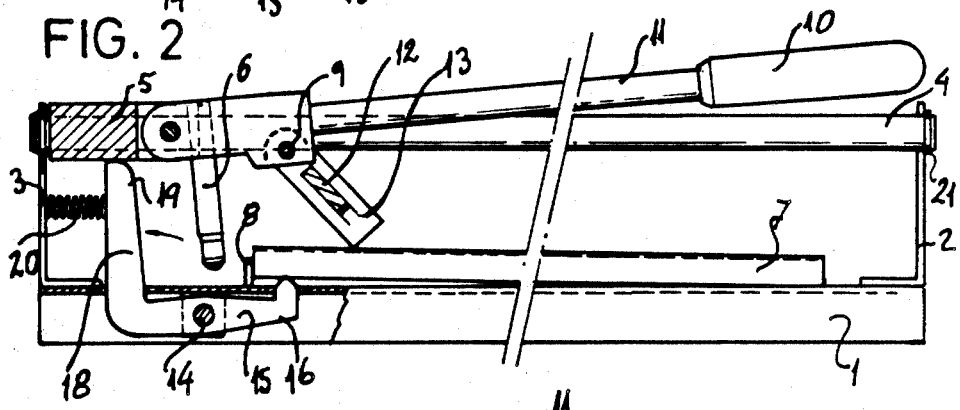
FIG. 2 is a view similar to FIG. 1 illustrating the stage at which an anvil or ceramic piece support is actuated.

When the head 5 reaches a position near the end of its course, the head 5 will act upon the rounded surface 19 of the lever 18, thus causing the lever 18 to oscillate against the action of the spring 20 until the head 5 becomes superimposed over the surface 19, thus retaining the lever 18 in this position in which the anvil 16 protrudes through the opening 17, thus slightly raising the scored piece 7 (FIG.2).

The fork-shaped piece 12 has traveled over the piece 7 in an inclined position, as also shown in FIG. 2.

Figure 3:
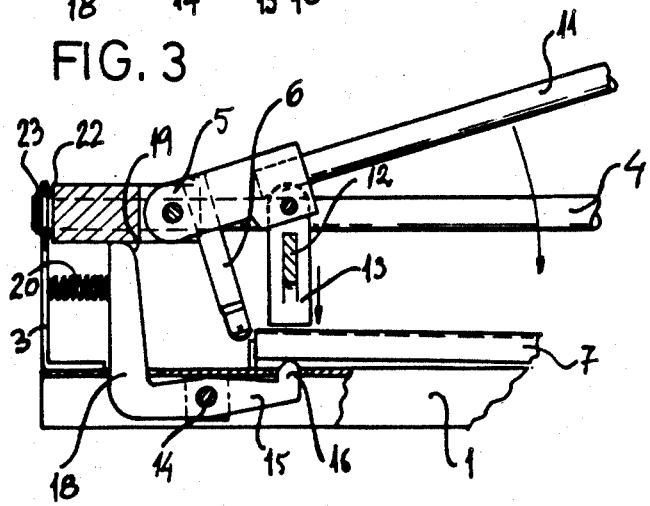
FIG. 3 is a view similar to FIGS. 1 and 2, illustrating the step or stage of compression or pressing against the piece for breaking and severing the scored piece into portions.
Figure 4:
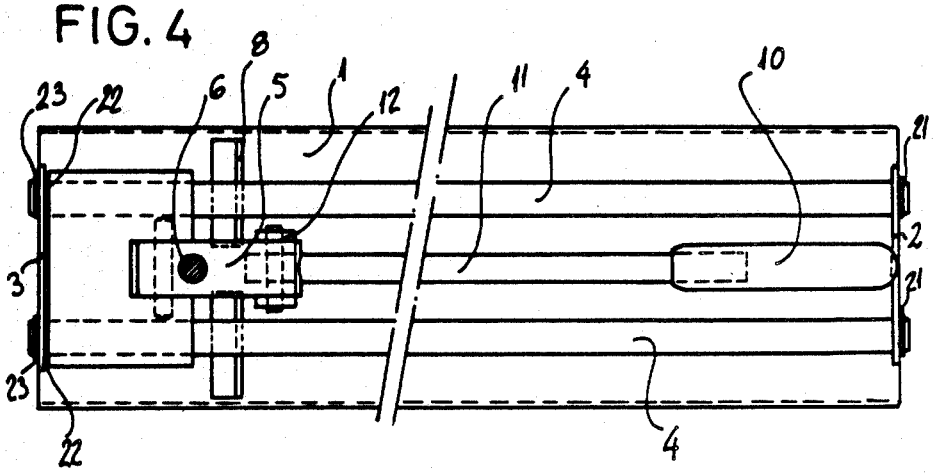
FIG. 4 is a top plan view of the invention apparatus.

The lever 11 is then slightly raised (FIG. 3), to cause the fork-shaped piece 12 to assume a vertical position, so that when the lever 11 is then moved downwardly, the fork-shaped piece 12 rests on both sides of the line scored or marked by the tool 6. By further pressing the lever 11, the piece 7 will be severed or broken over the anvil 16, into two parts.

The apparatus is then ready for a further operation in a reversed series of movements, to return to the position of FIG. 1.

As it is seen, the operation of the breaking or severing device of the present invention is greatly simplified and does not at all hinder the working by the operator who is able to visually control, at any time, the scoring or marking of the pieces to be cut. At the same time however, the invention apparatus is of strong, sturdy construction, which is suitable for all kinds of performance.

The preceding description of the present invention is merely exemplary, and is not intended to limit the scope thereof in any way.

I claim:

1. Apparatus for cutting substantially flat ceramic pieces, comprising a substantially flat frame for supporting a piece to be cut, at least one terminal support, at least one bar supported on said at least one terminal support, a head slidably mounted upon said at least one bar, a cutting line-scoring or marking tool supported upon said head, and breaking means for severing the scored or marked piece, said breaking means comprising a freely-oscillating fork having a pair of legs positioned to rest upon the piece on both sides of a breaking line scored or marked on a surface of the piece by said tool, during movement of said tool along the piece or at an instant when the piece is severed by said breaking means, wherein said fork is arranged rearwardly of a position of engagement of said tool with the surface of the piece, wherein said breaking means comprise a cranked lever articulately mounted upon said frame and under a resting plane of the piece to be cut on said frame, an opening in said frame to said resting plane thereof, with an end of said lever forming a support head and positioned to protrude through said opening when said end of said lever is pivoted upwardly, said opening substantially centered along the breaking line of the piece, and an opposite end of said lever forming a cranked arm situated to rest against said head when the piece is to be severed or broken, with said protruding lever head extending up through said opening in said frame and above the resting plane to support the piece as it is broken or severed.

2. The apparatus of claim 1, wherein said at least one terminal support is mounted upon said frame.

3. The apparatus of claim 2, additionally comprising two terminal supports mounted upon said frame, said at least one bar mounted upon said terminal supports.

4. The apparatus of claim 3, additionally comprising two bars, each bar mounted upon both said terminal supports, said bars being substantially parallel with one another, and said head slidably mounted upon both said parallel bars.

5. The apparatus of claim 1, additionally comprising a lever mounted upon said head for operating the same.

6. The apparatus of claim 5, wherein both said operating lever and said tool are pivotally mounted upon said head.

7. The apparatus of claim 1, wherein said fork is pivotally mounted upon said head.

8. The apparatus of claim 1, wherein said fork is mounted upon said head and substantially coplanar with said tool.

9. The apparatus of claim 8 wherein said tool is at all times visible between said legs of said fork.

10. The apparatus of claim 1, wherein said opposite end of said lever forming the cranked arm extends, in rest position, to a level slightly higher than said head, said head being positioned to depress said opposite end of said lever at the end of scoring or marking of the piece.

11. The apparatus of claim 10, wherein said opposite end of said lever is rounded at a zone of impingement with said head.

12. The apparatus of claim 10, wherein said breaking means additionally comprise spring means for biasing said lever into the rest position, with said support end positioned below said resting plane, said opposite lever end actuatable by said head against the biasing of said spring means.

13. The apparatus of claim 4, wherein said terminal supports are constituted by angle irons each formed of a metal plate of suitable thickness and secured to said frame, said bars being mounted to pierce through upper ends of wings of the angle irons and being secured thereto.

14. The apparatus of claim 13, wherein each of said bars is secured at one end thereof by an elastic washer on an outer side of one of said supports, and at the opposite end thereof, by elastic washers on both inner and outer sides of said other support.

15. The device of claim 14, wherein said legs of said fork are positioned to contact the piece on opposite sides of a score line along the same.

16. A device for cutting a scored ceramic piece, comprising a fork, said fork being freely swingable, having a pair of legs, and positioned, with said legs contacting the piece to be cut during or after scoring of the same, additionally comprising a pivotable lever having an end situated to pivot to contact the piece on a side thereof opposite said fork and raise the piece to support the same as said fork presses against the piece during cutting.

* * * * *